US005249710A

United States Patent [19]

Hassell et al.

[11] Patent Number: 5,249,710

[45] Date of Patent: Oct. 5, 1993

[54] BEVERAGE DISPENSER HAVING COLD PLATE WITH EVAPORATIVE COOLING

[75] Inventors: David A. Hassell, Anoka, Minn.; Craig A. Swanson, San Antonio, Tex.

[73] Assignee: IMI Cornelius Inc., Anoka, Minn.

[21] Appl. No.: 908,096

[22] Filed: Jul. 2, 1992

[51] Int. Cl.[5] ..... B67D 5/62

[52] U.S. Cl. ..... 222/146.6; 62/390; 62/398; 62/399; 222/64; 222/129.1

[58] Field of Search ..... 222/129.1, 146.6, 64, 222/65, 66, 67; 62/389, 390, 393, 394, 396, 398, 399, 400; 261/DIG. 7

[56] References Cited

U.S. PATENT DOCUMENTS

| | | | |
|---|---|---|---|
| 2,082,975 | 6/1937 | Riesgo | 62/390 |
| 2,327,910 | 8/1943 | Levine | 62/390 X |
| 2,362,104 | 11/1944 | Smith | 62/390 |
| 2,598,751 | 6/1952 | Berkowitz et al. | 62/390 |
| 3,011,323 | 12/1961 | Jaeger | 222/146.6 X |
| 3,224,641 | 12/1965 | Morgan | 222/146.6 X |
| 4,291,546 | 9/1981 | Rodth | 62/398 |
| 4,322,954 | 4/1982 | Sheehan et al. | 62/371 |
| 4,545,505 | 10/1985 | Mueller et al. | 222/65 |
| 4,555,045 | 11/1985 | Rodth et al. | 222/146.6 X |
| 4,617,807 | 10/1986 | Pritchett et al. | 62/399 |
| 4,651,538 | 3/1987 | Bull et al. | 222/146.6 X |
| 4,676,400 | 6/1987 | Lamont et al. | 222/146.6 |
| 4,678,104 | 7/1987 | Pritchett | 222/146.6 |
| 4,679,408 | 7/1987 | Nelson | 222/146.6 X |
| 4,730,463 | 3/1988 | Stanfill | 222/146.6 X |
| 4,781,309 | 11/1988 | Vogel | 222/146.6 X |
| 4,888,961 | 12/1989 | McMichael | 62/399 X |
| 4,921,134 | 5/1990 | Aschberger et al. | 222/64 |
| 4,958,505 | 9/1990 | Swanson | 222/146.6 X |
| 5,080,261 | 1/1992 | Green | 222/129.1 |
| 5,086,951 | 2/1992 | Nakayama et al. | 222/146.6 X |
| 5,115,956 | 5/1992 | Kirschner et al. | 222/129.1 |
| 5,124,088 | 6/1992 | Stumphauzer | 222/129.1 X |
| 5,139,708 | 8/1992 | Scott | 222/64 X |

FOREIGN PATENT DOCUMENTS

| | | | |
|---|---|---|---|
| 0139394 | 5/1990 | Japan | 222/146.6 |
| 2194508 | 3/1988 | United Kingdom | 222/146.6 |

*Primary Examiner*—Kevin P. Shaver
*Attorney, Agent, or Firm*—Sten Erik Hakanson

[57] ABSTRACT

An ice cooled beverage dispensing apparatus including an L-shaped cold plate having a horizontal portion and a vertical portion. The cold plate includes a plurality of beverage lines extending therethrough and, in particular, extending vertically through the vertical portion of the cold plate. The beverage fluid lines provide for connecting between a plurality of beverage dispensing valves and the cold plate. A heat tube extends partially into the cold plate vertical portion and terminates with an evaporative cooling tube portion adjacent a carbonated water manifold extending adjacent the beverage dispensing valves. A carbonator is integral with the cold plate and located generally at the juncture of the vertical and horizontal portions. Metal thermal jackets cover the portions of the beverage fluid lines extending between the cold plate and the beverage dispensing valves. In operation, the heat tube provides for evaporating cooling of the manifold. The metal jackets provide additional thermal cooling of the portion of the beverage fluid lines.

8 Claims, 9 Drawing Sheets

46
52
50
50a
38
64
54
10
3
49
48
12
66
22
20
28
14v
16
14h
68
26
24
32
2
34
2
3
18
38
14
36
36
36

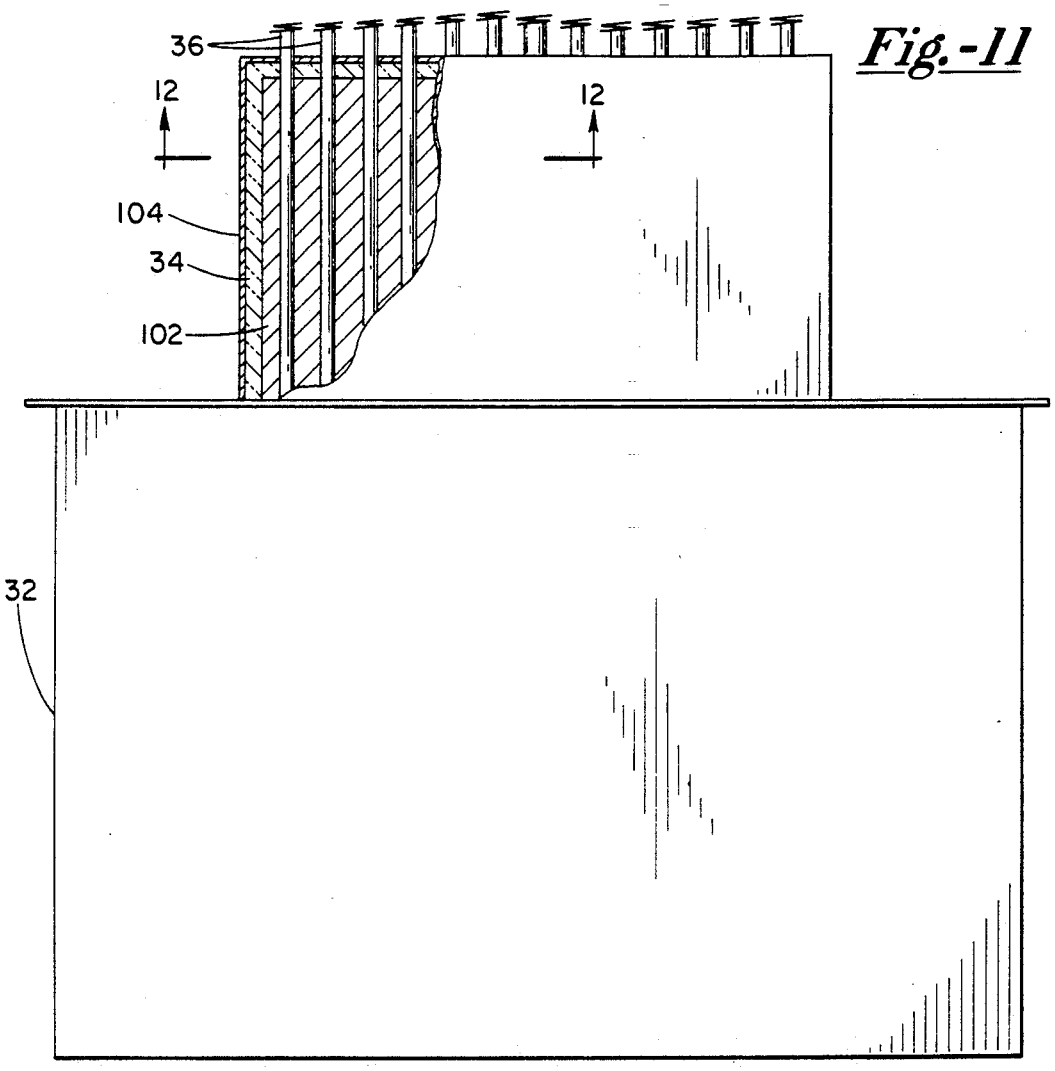
Fig.-11
Fig.-12
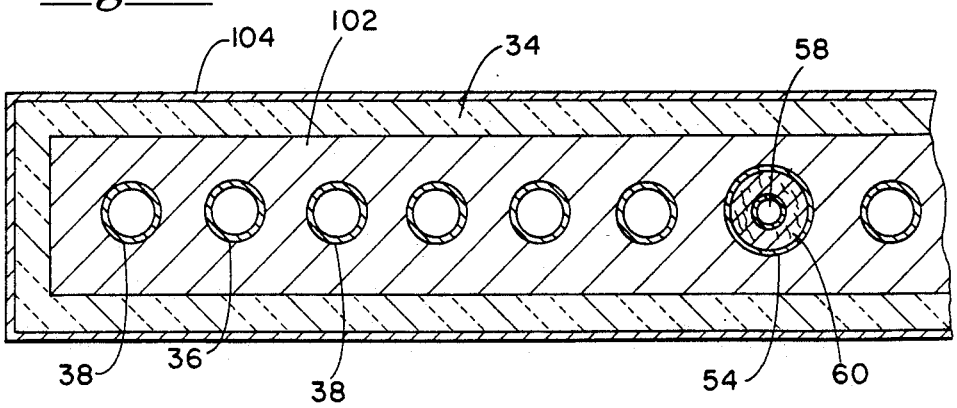

BEVERAGE DISPENSER HAVING COLD PLATE WITH EVAPORATIVE COOLING

BACKGROUND

1. Field of the Invention

The present invention relates generally to ice cooled post-mix beverage dispensers, and particularly to such dispensers having improved casual drink performance.

2. Background Art

Ice cooled beverage dispensers are well known in the art. Such dispensers incorporate cold plates for cooling beverage components as they flow through serpentine pathways therein. A problem has long been recognized with what has been referred to as "casually" drawn drinks, wherein, if there exists a long interval of time between the drawing of individual drinks, the beverage constituents in the line between the beverage valve and the cold plate, can become warmed and result in a drink having an unsatisfactorally high temperature. Various strategies are known for periodically purging the warmed beverage constituent, based upon a predetermined time period or sensed temperature. Alternatively, systems are known for continuously bleeding off such beverage constituent liquid. However, such purging systems can require the use of additional solenoid operated valves for releasing such warmed drink constituents, thereby adding cost and complexity, and potentially reducing the reliability of such beverage dispensers. Additionally, providing for the continuous release of liquid is wasteful and energy inefficient.

Accordingly, it would be highly desirable to have an ice cooled beverage dispenser that provides for maintaining of the beverage constituents at a satisfactory temperature without the necessity of additional expensive hardware, and that is not wasteful or energy inefficient.

SUMMARY OF THE INVENTION

The ice cooled beverage dispenser of the present invention includes an L-shaped cold plate located within an ice retaining bin. The cold plate is one integral unit having a horizontal portion and a vertical portion. The horizontal portion includes a plurality of beverage constituent lines extending there through for providing heat exchange with ice retained in the bin. In one embodiment of the present invention a carbonated water manifold is retained within the ice plate, generally at the junction of the vertical and horizontal portions thereof. A plurality of carbonated water lines extend from the manifold in one-to-one correspondence with beverage dispensing valves secured to a tower extending above the vertical portion of the cold plate. The carbonated water lines extend through the vertical portion of the cold plate and are connected individually to each beverage dispensing valve. The vertical portion also includes a plurality of syrup lines extending there through and connected individually to each of the beverage dispensing valves.

In a further embodiment, the present invention includes a heat tube extending substantially vertically, with a lower portion extending into a bore drilled into the vertical portion of the cold plate. An upper portion of the heat tube extends above the vertical portion of the cold plate and exists in close physical contact with a carbonated water manifold extending substantially horizontally and adjacent the beverage dispensing valves. The heat tube is a sealed unit having, in cross-section, an exterior tube and an interior tube and wick material there between. The heat tube terminates adjacent the manifold with an expansion tube portion.

In a further embodiment, a carbonator is cast within the cold plate at the intersection of the vertical and horizontal portions of the cold plate. The carbonator includes an access tube extending therefrom around which the vertical cold plate portion is formed. A carbonator level sensing means is inserted through the tube after casting for providing level sensing means in the carbonator. A gas pressure relief valve is secured to the top of the tube through which the level sensing means is inserted as well as means for introducing carbon dioxide gas into the carbonator through the access tube.

The present invention also includes a pair of clips for retaining the plurality of serpentine beverage coils prior to formation of the cold plate. The clips provide for retaining the beverage coils in a particular orientation so that in the resulting cast cold plate the coils are always at a particular desired and consistent distance from the top surface of the cold plate.

In operation, the carbonator, or manifold, within the cold plate provides for locating a reserve of cold carbonated water therein. Also, the vertical portion of the cold plate provides for cooling a majority of the beverage constituents that exist between the carbonator or manifold and the dispensing valves. Thus, very little volume thereof can become heated, and if it does, will not substantially increase the temperature of the casually drawn drink.

It can be understood that the fluid within the sealed heat tube will rise upwardly from the cold plate by a wicking action through the wick material. Thus, when the operating fluid reaches the expansion chamber it can vaporize thereby causing a cooling of the immediately adjacent carbonated water manifold. This evaporated gas can then flow down the inner heat tube, located within the vertical portion of the cold plate, and re-condense as it reaches towards the bottom thereof. Thus, the heat tube provides a strategy for cooling the carbonated water immediately adjacent the valves in a manner that does not require the addition of moving parts, such as solenoids and valves.

In a further embodiment of the present invention, portions of the beverage constituent lines extending between the top of the vertical portion of the cold plate and the beverage valves are each enclosed in metal jacket halves. In particular, a jacket half provides for a mass of metal, such as aluminum, which fit together on each side of the beverage tube and are then held in place by a clip means. The bottoms of each jacket half are fitted in close contact into recesses contained in the top of the ice plate vertical portion. In this manner, the portions of the beverage constituent tubes between the top of the vertical portion of the cold plate and the valves are themselves contained in a mass of metal which provides for additional heat exchange cooling thereof.

DESCRIPTION OF THE DRAWINGS

A further understanding of the structure and operation, objects and advantages of the present invention can be had by referring to the following detailed description which refers to the following figures, wherein:

FIG. 11 shows a front plan partial cross-sectional view of a further embodiment of the present invention.

FIG. 12 shows a cross-sectional view along line 11—11 of FIG. 10.

DETAILED DESCRIPTION

Figure 1:
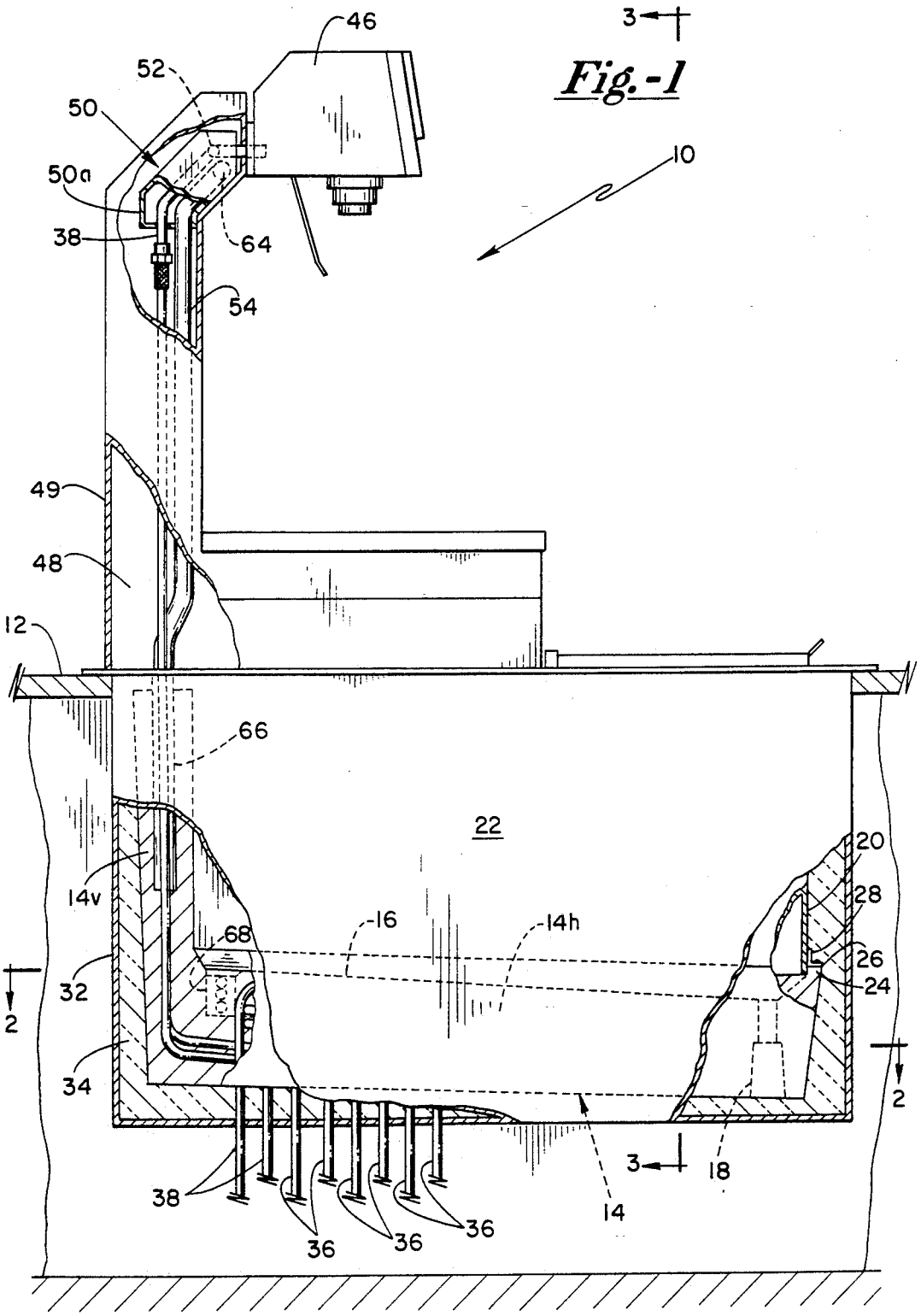
FIG. 1 shows a side plan partial cross-sectional view of an embodiment of the present invention.
Figure 2:
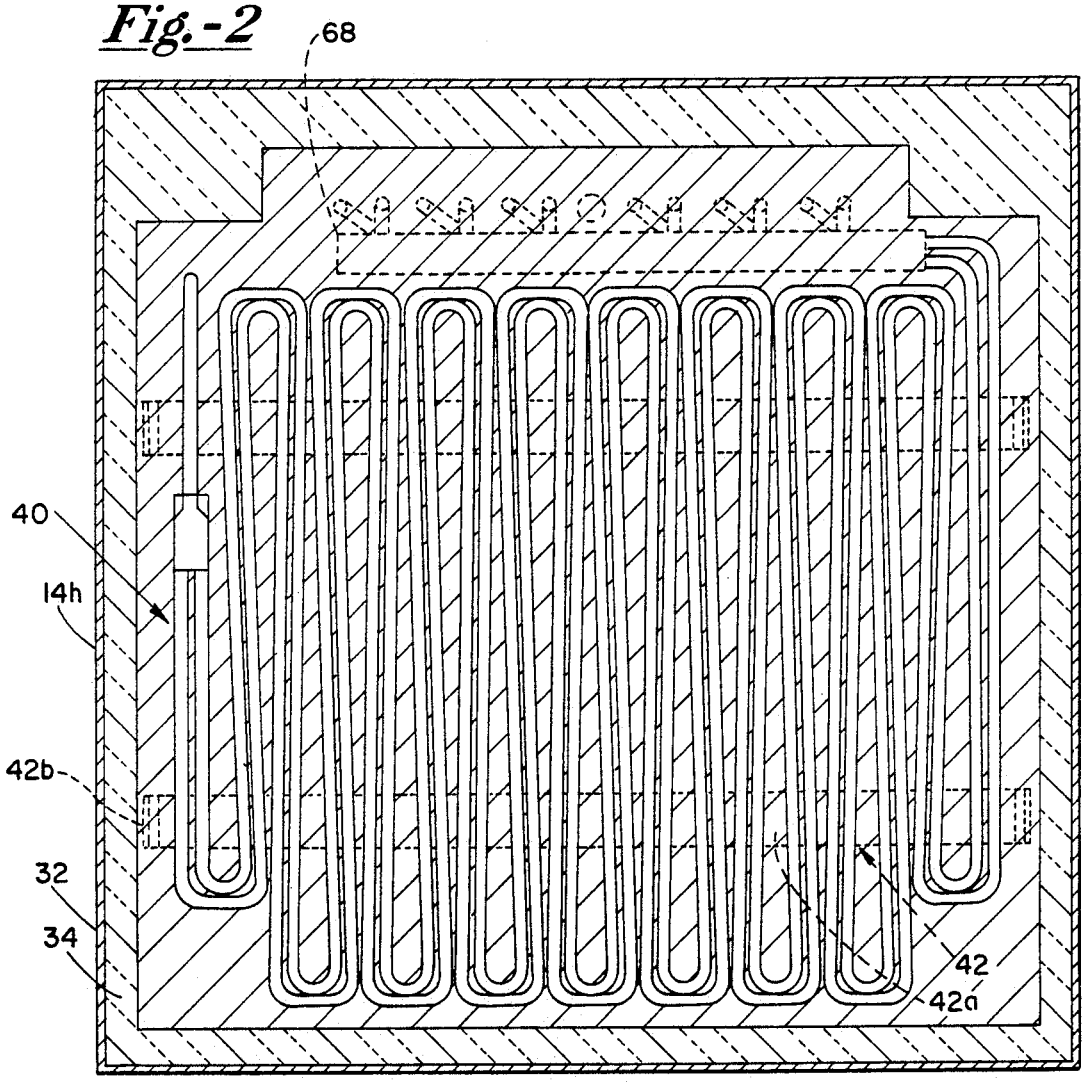
FIG. 2 shows a top plan cross-sectional view along lines 2—2 of FIG. 1.
Figure 3:
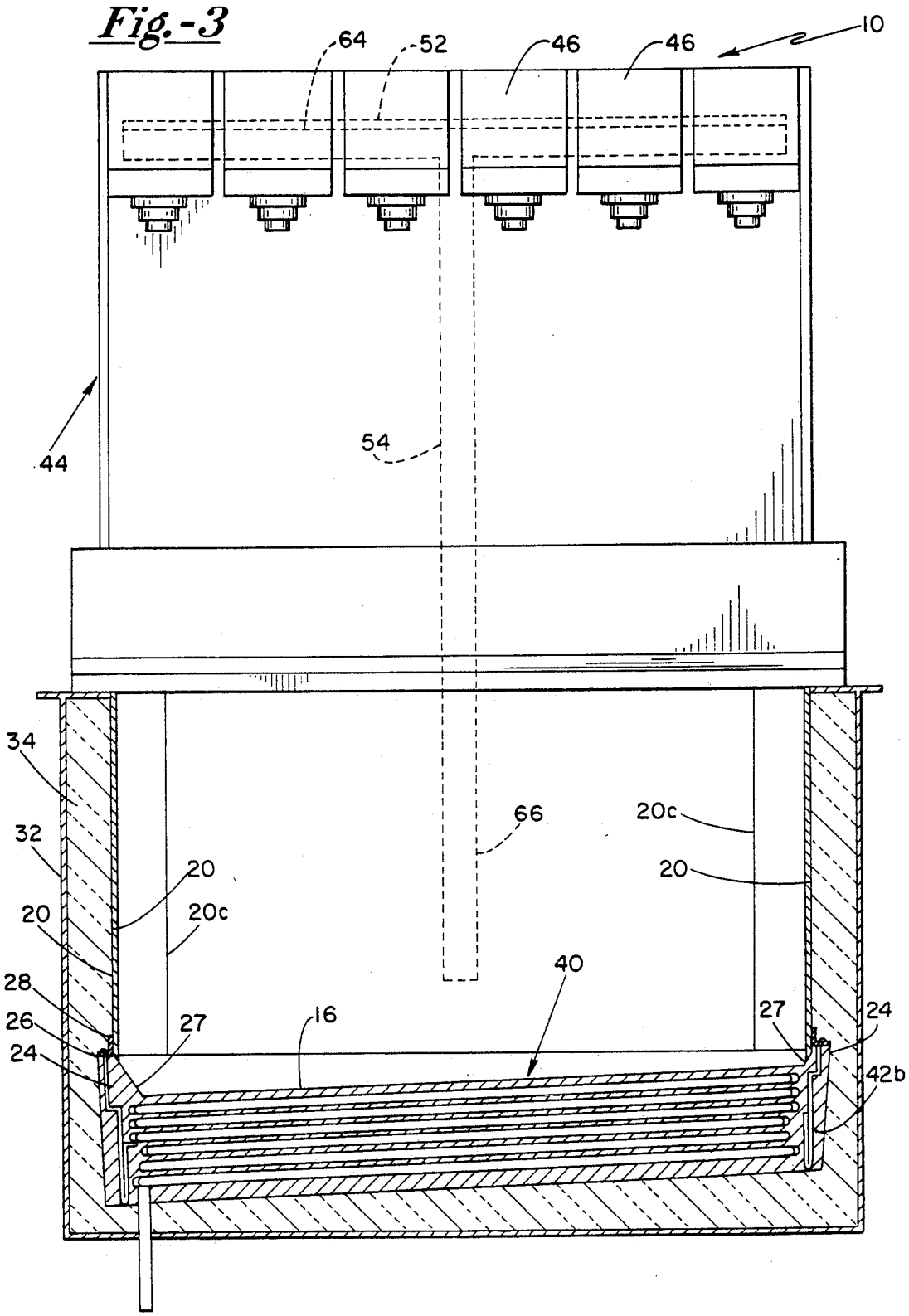
FIG. 3 shows a front plan view of the embodiment of FIG. 1.
Figure 4:
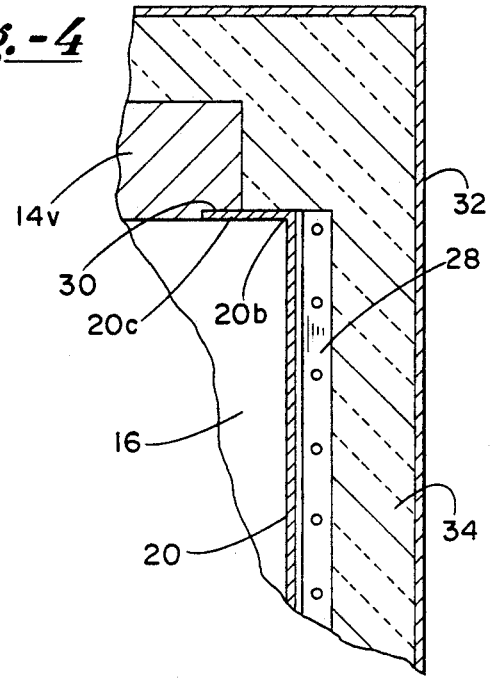
FIG. 4 shows an enlarged cross sectional top plan view of the structure of the joining of the ice bin to the cold plate vertical portion.

An embodiment of the beverage dispenser of the present invention is seen in FIG. 1 and generally designated by the numeral 10. Dispenser 10 is of the "drop-in" type wherein dispenser 10 is inserted below and rests upon a counter top 12, in a beverage retail area. Dispenser 10 includes an L-shaped cold plate 14 having a horizontal portion 14*h* and a vertical portion 14*v*. Cold plate 14 includes a top surface 16 which is angled downwardly in both a rear-to-front direction away from vertical portion 14*v* towards a drain 18, and in a side-to-side direction from right to left, as viewed in FIG. 3. A sheet metal piece 20 forms three of four sides of an ice retaining bin space 22, and cold plate vertical portion 14*v* forms the fourth side. Piece 20 is bent forming two vertical radiused edges 20*a* for defining the three sides of the bin space 22, and is bent along to vertical edges 20*b* forming tabs 20*c*. In the preferred form of the present invention, the bottom edge of piece 20 is secured to horizontal plate portion 14*h* in the manner described in U.S. Pat. No. 4,958,505, the contents of which are incorporated herein by reference. Specifically, plate portion 14*h* includes an upstanding lip 24 having a top shoulder edge 26 and an inclined portion 27. Thus, the bottom edge of piece 20 is press fit within lips 24 and down onto inclined portions 27. A sealent is used along this bottom edge and between it and lip 24, and is secured thereto by, for example, brackets 28 secured to that bottom edge and to shoulder 26. As seen by referring to FIG. 4, the vertical edges of tabs 20*c* are inserted into vertical relieved or shoulder areas 30 extending along portion 14*v* and are secured thereto by a sealent-/adhesive.

Cold plate 14 is held within an outer housing 32, and as known in the art, foam insulation 34 is injected between cold plate 14 and bin sides 22, and outer housing 32. As is also understood in the art, cold plate 14 can include a plurality of beverage lines 36 and water lines 38 extending there through in a serpentine fashion. A combination of lines 36 and 38 forms what is generally referred to as a coil pack 40. In the present invention a pair of coil pack positioning strips 42 extend through the cold pack 40 on opposite ends thereof. Strips 42 include an elongate flat portion 42*a* extending through the coil pack 40 and vertical spacer leg ends 42*b*.

Beverage dispenser 10 includes a beverage dispensing tower 44 having a plurality of valves 46 secured thereto. Tower 44 includes an interior space 48, defined by a tower housing 49, for containing beverage and water lines 36 and 38 as they extend out of and above vertical portion 14*v*. In one form of the present invention, an insulated water manifold 50 includes an outer housing 50*a* and a manifold 52 to which all the carbonated water lines 38 are connected and from which the carbonated water lines extend and connect to each of the valves 46. Further foam insulation 34 is injected between manifold housing 50 and manifold 52.

Figure 5:
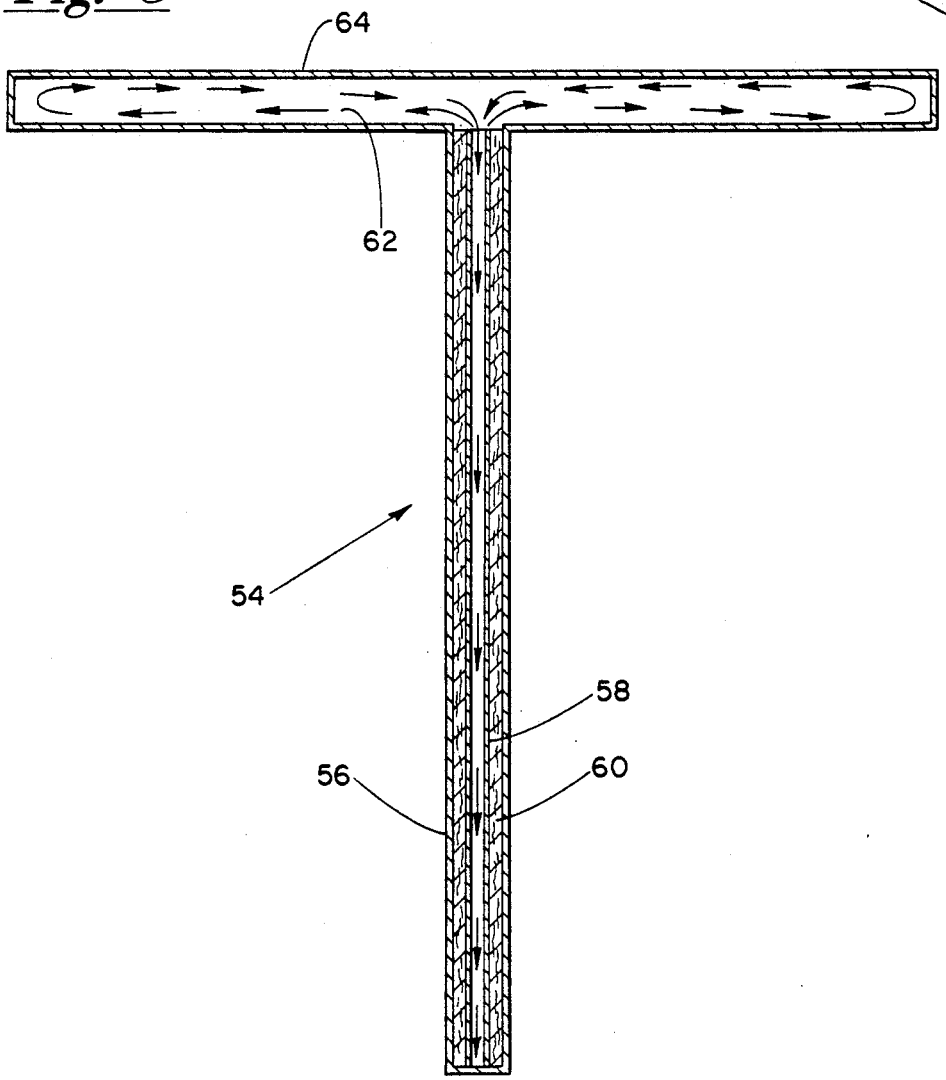
FIG. 5 shows a detailed cross-sectional view of a heat tube.
Figure 6:
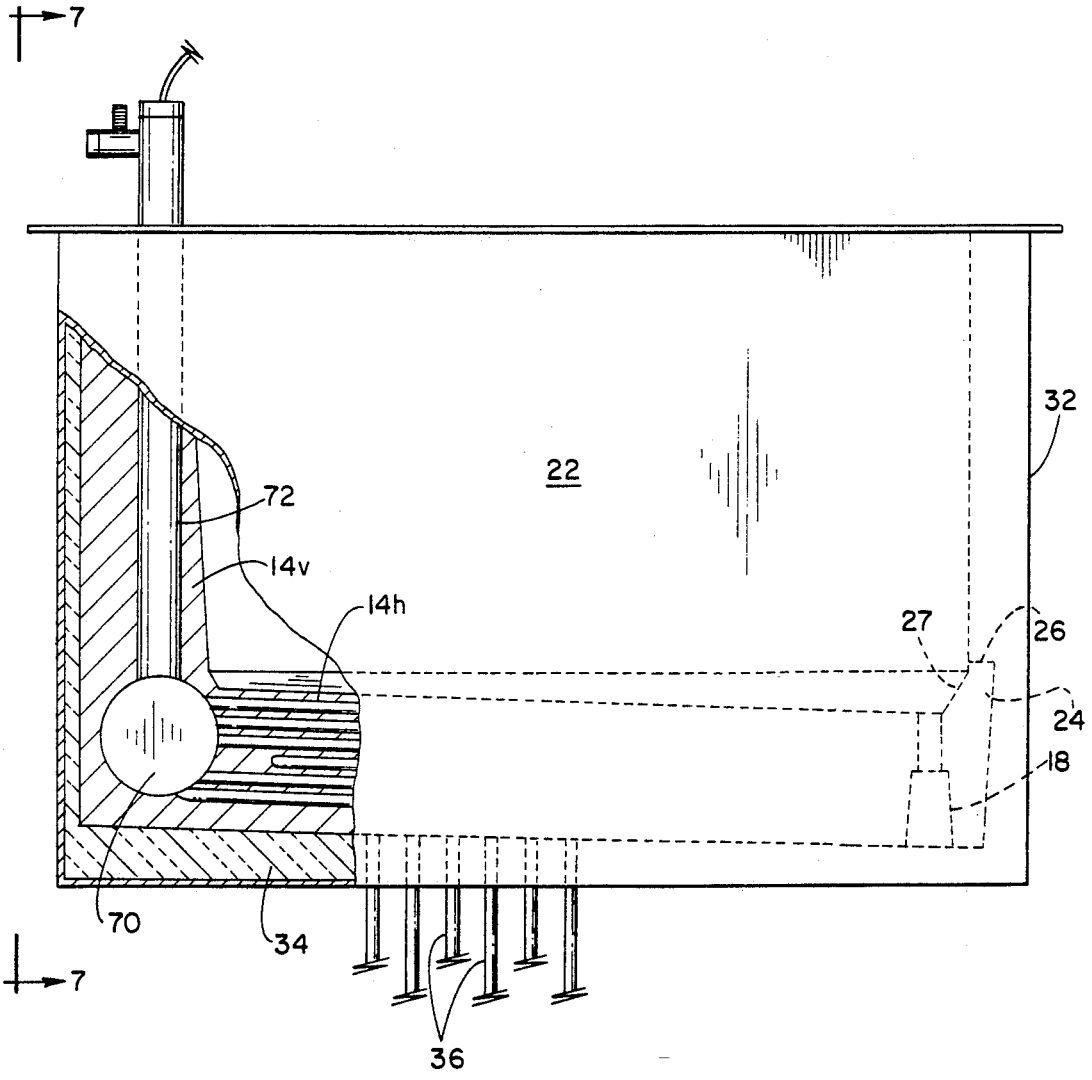
FIG. 6 shows a side plan partial cross-sectional view of a further embodiment of the present invention.
Figure 7:
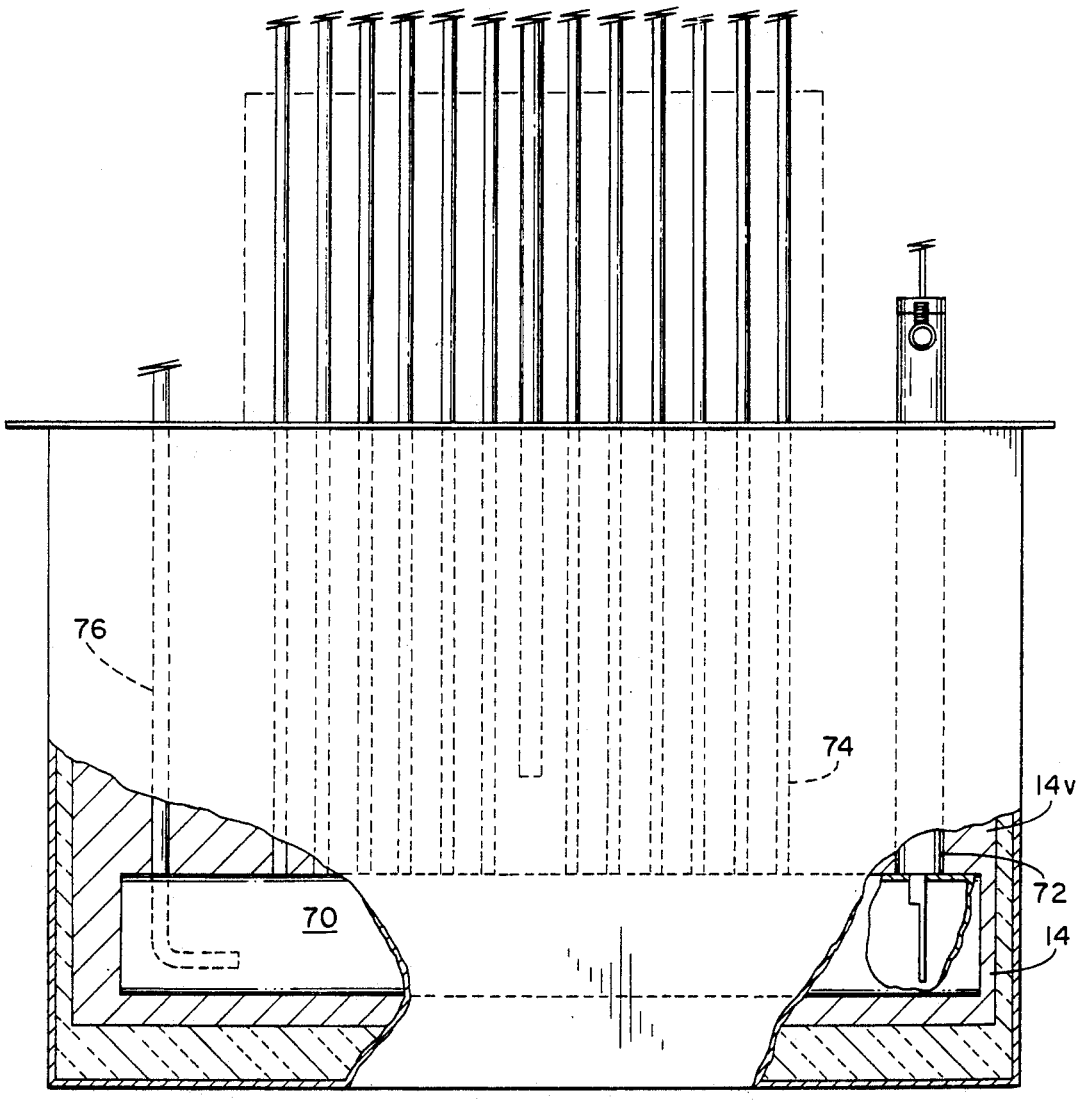
FIG. 7 shows a rear plan partial cross-sectional view along lines 7—7 of FIG. 6.
Figure 8:
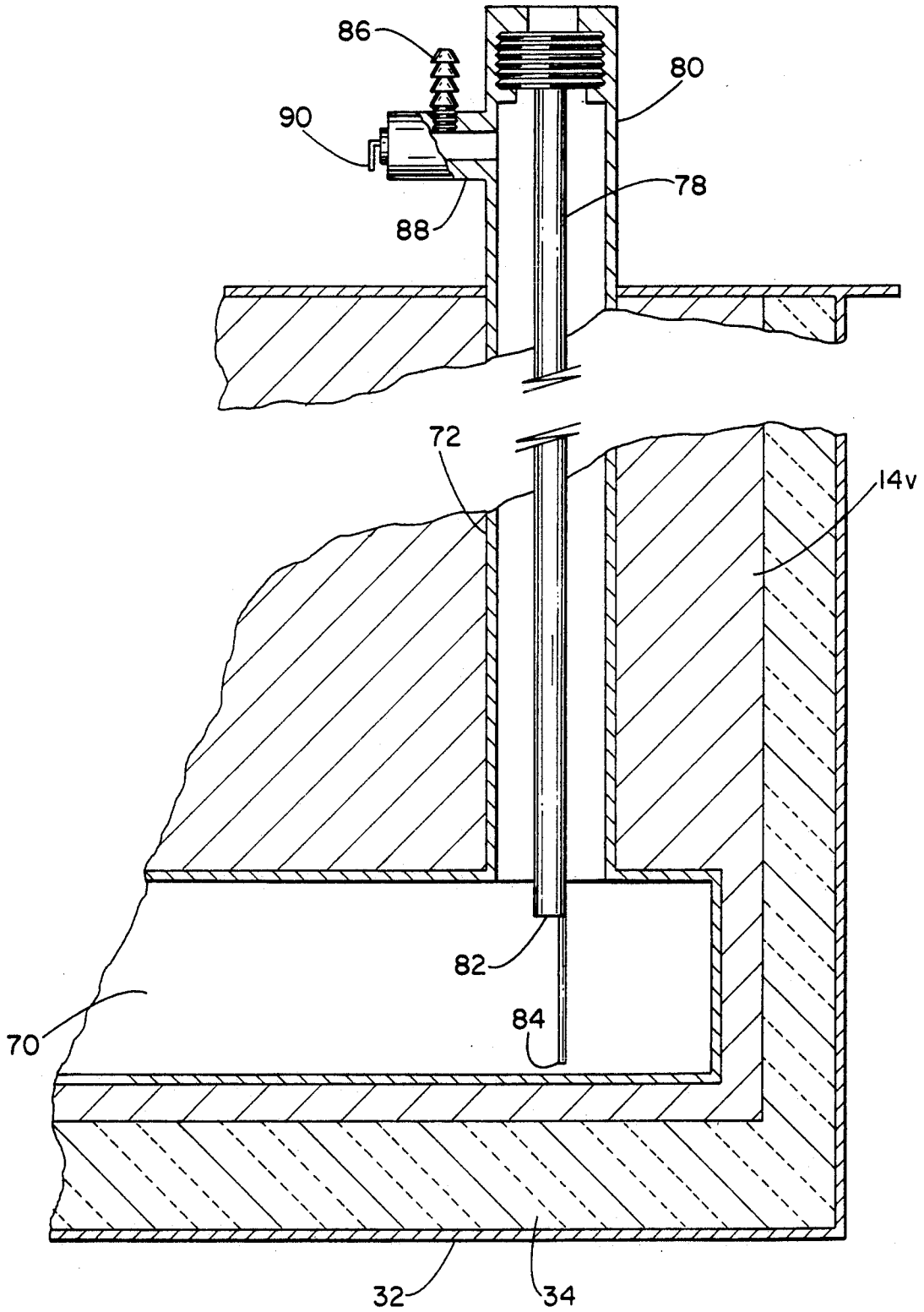
FIG. 8 shows a detailed cross-sectional view of the embodiment of FIG. 6.
Figure 9:
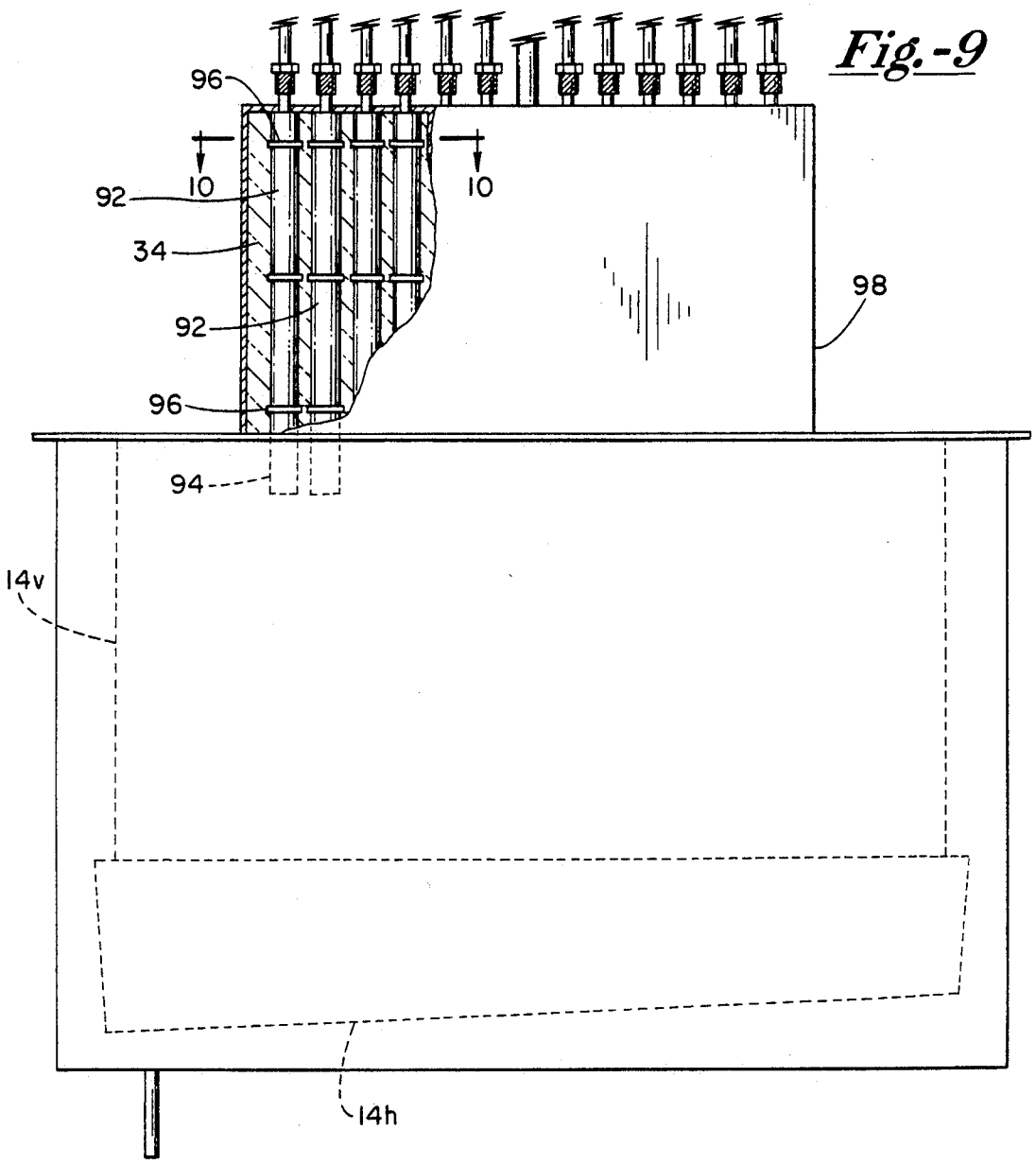
FIG. 9 shows a front plan partial cross-sectional view of a further embodiment of the present invention.
Figure 10:
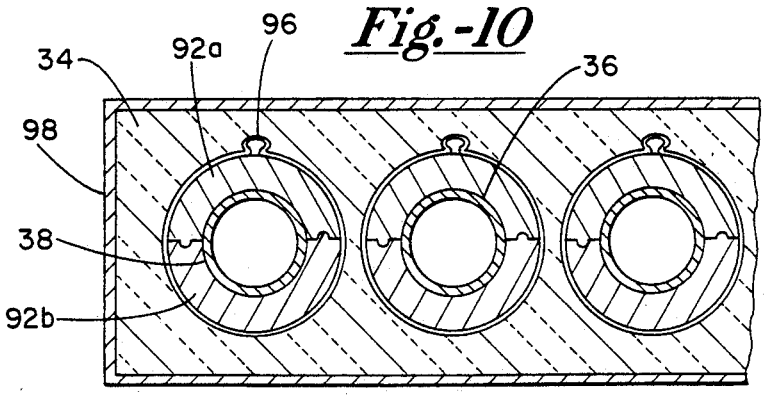
FIG. 10 shows a cross-sectional view along lines 9—9 of FIG. 8.

In one embodiment of the present invention, a heat tube is employed for purposes of cooling manifold 52. As seen in FIG. 5, heat tubes, as are known in the art, include an outer tube housing 56 and an inner tube 58 and a wicking material 60 there between. An evaporative fluid, such as a suitable alcohol, is also contained within tubes 58 and wick material 60. Tubes 56 and 58 are in fluid communication with an evaporative chamber 62 defined by a horizontal tubular housing 64. The vertical portion 56 of heat tube 44 is inserted into a vertical bore 66 located centrally of vertical plate portion 14*v*. Tube 54 extends upwardly through tower area 48 wherein horizontal expansion chamber 54 extends in intimate physical heat exchange contact with water manifold 52. A water manifold 68 is shown in ghost outline and extends horizontally within cold plate 14 at the junction of portions 14*h* and 14*v*. Manifold 68 is fluidly connected to lines 38 within plate 14, and lines 38 emanate there from and extend upward through plate portion 14*v*. Such manifold 68 can be used in conjunction with a manifold 52, or in an embodiment not having a heat tube 54, can be the sole provider of a reservoir of the cooled carbonated water delivered to valves 46.

As seen by referring to FIG.'S 6, 7 and 8, a further embodiment of the present invention includes a carbonator 70 extending horizontally at the junction of cold plate portions 14*h* and 14*v*. Carbonator 70 includes an access tube 72, a plurality of water lines 74, and a water supply J-tube 76, secured thereto and extending vertically therefrom. It will be appreciated by those of skill that carbonator 70 is cast within cold plate 14 with tubes 72, 74, and 76 extending vertically through vertical portion 14*v* and above the top surface thereof. After formation of cold plate 14, a water level sensor 78 is inserted through access tube 72 and threadably secured a top end 80 thereof. Sensor 78 includes high and low level sensor contacts 82 and 84, respectively, which are maintained at a desired position within carbonator 70. A carbon dioxide gas fitting 86 is in fluid contact with the interior of tube 72 through an extension 88 extending vertically from top tube portion 80. Extension portion 88 also includes a pressure release safety valve 90. Fitting 86 provides for connection to a source of pressurized carbon dioxide, not shown. Water inlet J-tube 76 is connected to a source of water, also not shown. As is understood in the art, carbonated water lines 74 are, in turn, connected to the plurality of valve 46.

As seen by referring to FIG.'S 9 and 10, a further embodiment of the present invention includes metal jackets 92 comprised of jacket halves 92*a* and 92*b*. Halves 92*a* and 92*b* include interlocking means are secured around water lines 38 and syrup lines 36 as they extend upwardly above of cold plate vertical portion 14*v*. In particular, recesses 94 are formed in vertical portion 14*v* and serve to receive a portion of the lower ends of metal jackets 92. Each half of jacket 92 is secured around the respective syrup lines 36 and water lines 38 by clip means 96. All of the jackets 92 are contained within a housing 98, which housing is injected with further foam insulation 34. Housing 98 can form the tower housing 49 itself, or can alternatively be held within an area 48 of a tower housing.

As seen in FIG.'S 11 and 12, a further embodiment of the present invention is shown wherein, in addition to cold plate horizontal portion 14*h* and vertical portion 14*v*, there is a further cold plate vertical portion 102. Vertical portions 102 and 14*v* and horizontal portion 14*h* are integral and cast in the same mold. It will be appreciated that the further vertical portion 102 is lesser width than vertical portion 14*v* and is cast to extend around syrup lines 36 and carbonated water lines 38 that have been grouped together to minimize the width of portion 102. Portion 102 is retained within an insulated housing 104. As with the embodiment mentioned above, housing 104 can form the vertical housing portion 49 of a tower 44 or can be contained within a further tower housing.

The operation of the present invention can be understood, wherein cold plate 14 provides for cooling of carbonated water lines 38 and syrup lines 36 in the horizontal portion and vertical portion thereof. Thus, unlike a traditional horizontal cold plate as would be represented by portion 14*v*, the syrup and water lines are cooled also by passage through vertical portion 14*v*, which provides for additional thermal exchange by physical contact with ice contained within bin area 22. Additionally, heat tube 54 provides for cooling of manifold 52. In particular, the evaporative fluid is transported through wick material 60 upwardly towards horizontal expansion chamber 64. In chamber 64, the wicking fluid can expand into a gaseous state which expansion results in evaporative cooling of the surrounding area. As tube 64 is in heat exchange contact with manifold 52, evaporative cooling of carbonated water held therein is accomplished. In completion of the cycle, the working fluid can travel down tubes 58 and re-condense at the bottom thereof as it becomes cooled by thermal contact with vertical cold plate portion 14*v*. Thus, the working fluid can continue this evaporating and condensing cycle as long as sufficient ice is contained within bin area 22. Therefore, it can be appreciated that a constantly cooled reserve of carbonated water is held within manifold 52 closely adjacent valves 46 so that casually drawn drinks will be maintained at a reasonably low and desirable temperature. Moreover, it can be seen that this evaporative cooling of manifold 52 is accomplished without the addition of any moving parts.

In the embodiment as shown in FIG.'S 6, 7 and 8, the use of a carbonator cast within a cold plate provides for a large reserve of cold carbonated water that can be provided to valves 46. This large reserve of carbonated water can help to reduce somewhat casual drawn drink temperature problems and, of course, provides for a large supply of carbonated water under high draw situations. The embodiment wherein the carbonator 70 cast within cold plate 14 also uses a manifold 52 cooled by an evaporative heat tube 54 provides for further assurance that intermittently drawn drinks will be of a sufficient low temperature. Also, it can be understood that the forming of a carbonator having the tubes 72, 74 and 76 secured thereto and extending therefrom prior to the casting of carbonator within cold plate 14, provides a reasonable means for gaining access to carbonator 70 after the casting process. Such access is needed for inserting level sensor 78 and for providing means for inlet carbon dioxide gas and flat water. Such a formation technique is much more desirable, energy efficient and less costly than, for example, drilling bores through vertical portion 14 after the casting process in order to gain access to carbonator 70. In the embodiment as shown in FIG.'S 9 and 10, it can be understood that metal jackets 92 provide for thermal heat exchange cooling of tubes 36 and 38. In such an embodiment, jackets halves 92*a* and 92*b* can be secured around tubes 36 and 38 after the casting of cold plate 14. In addition, jackets 92*a* and 92*b* represent somewhat less metal mass and therefore present an advantage of lighter weight and the use of less material. In this manner, the embodiment of FIG.'S 9 and 10 provides for cooling of tubes 36 and 38 up to the point of securing with valves 46. Thus, only a small volume of liquid can warm between drinks, which volume can not reduce appreciably the resulting drawn drink temperature.

As seen in the embodiment described in FIG.'S 11 and 12, the further addition of cold plate extension 102 provides for a simplified means of further casting cold plate heat exchange material around tubes 36 and 38. Thus, as opposed to the embodiment shown in FIG.'S 9 and 10, somewhat more cold plate metal material is used, however, the construction thereof is simplified as there is no need to assemble jacket halves 92*a* and 92*b* secured together with clips 96.

As is known in the art, cold plates are formed in clam shell type molds. There has been a long problem with the coil packs contained therein varying as to their position with respect to the surfaces of the cold plate. This occurs when the coil pack floats or otherwise moves before the casting has solidified. Thus, in the present invention, coil pack spacers 42 extend through coil packs 40 wherein the foot ends 46 provide for holding the coil pack in a particular position within the clam shell mold when it is closed thereon. Thus, when molten aluminum is poured into the mold, spacers 42 provide for securing coil pack 40 at a desired and consistent distance, particularly from the top surface 16 of horizontal portion 14*h*. In this manner, cold plates can be formed that preform consistently as their coil pack is positioned at substantially the same desired location within the final cast plate.

Various modifications and additions to the present invention can be made by those of skill in the art, without exceeding the spirit and scope thereof. In particular, it can be understood that various aspects of the embodiment shown in here can be used in different combinations. Thus, heat tube 54 can be used in the embodiments shown in FIG.'S 8–11 wherein a manifold 52 is also included adjacent valves 44.

We claim:

1. An ice cooled beverage dispenser comprising:

an L-shaped cold plate having a bottom horizontal portion and a vertical portion, the cold plate held within an ice retaining bin, and the cold plate having a plurality of beverage fluid lines extending there through, the beverage lines extending in a generally serpentine fashion through the bottom portion of the cold plate and extending generally vertically through the vertical cold plate portion, and the beverage fluid lines extending from the cold plate vertical portion and fluidly connected to a carbonated water manifold, the manifold for retaining a volume of carbonated water therein and fluidly connected to one or more beverage dispensing valves, and a heat tube, the heat tube being a sealed container for holding an evaporative heat transfer fluid and having a bottom liquid containing end for holding a volume of the transfer fluid, and an evaporative cooling chamber end in fluid communication with the bottom end, and the bottom end extending generally vertically within the cold plate vertical portion and in heat exchange thermal contact with a portion thereof and extending upwardly therefrom to the cooling chamber end, the cooling chamber end lying in heat exchange physical contact with the carbonated water distribution manifold, wherein the heat tube provides for evaporative cooling of the carbonated water held in the manifold through repeated evaporative cooling in the cooling chamber and recondensation in the heat tube bottom end of the evaporative heat transfer fluid.

2. The dispenser as defined in claim 1, and further including a carbonator retained generally at a junction of the bottom and vertical cold plate portions and in thermal contact therewith, the carbonator having a water inlet for connecting to a source of potable water, a carbon dioxide gas inlet for connecting to a source of pressurized carbon dioxide gas, a carbonated water outlet for connecting to the manifold and means for regulating the level of water therein.

3. An ice cooled beverage dispenser comprising:

an L-shaped cold plate having a bottom horizontal portion and a vertical portion, the cold plate held within an ice retaining bin, a beverage dispensing valve support means secured to a top surface of the bin above the cold plate vertical portion and extending there above for supporting one or more beverage dispensing valves thereon, and the cold plate having a plurality of beverage fluid lines extending there through, the beverage lines extending in a generally serpentine fashion through the bottom portion of the cold plate and extending generally vertically through the vertical cold plate portion and the beverage fluid lines extending from the cold plate vertical portion and through an interior of the valve support means for connecting to a carbonated water manifold, the manifold for retaining a volume of carbonated water therein and fluidly connected to the one or more beverage dispensing valves, and a heat tube, the heat tube being a sealed container for holding an evaporative heat transfer fluid and having a bottom liquid containing end for holding a volume of the transfer fluid, and an evaporative cooling chamber end in fluid communication with the bottom end, and the bottom end extending generally vertically within the cold plate vertical portion and in heat exchange thermal contact with a portion thereof and extending upwardly therefrom to the cooling chamber end, the cooling chamber end lying in heat exchange physical contact with the carbonated water distribution manifold wherein the heat tube provides for evaporative cooling of the carbonated water held in the manifold through repeated evaporative cooling in the cooling chamber and recondensation in the heat tube bottom end of the evaporative heat transfer fluid.

4. The dispenser as defined in claim 3, and the cold plate vertical portion having a further extension portion integral therewith and extending within the valve support means and around the beverage lines for providing further heat exchange cooling thereof.

5. The dispenser as defined in claim 4, and the further extension portion having a layer of insulation around an exterior surface thereof.

6. The dispenser as defined in claim 3, and further including beverage line jackets for securing around the beverage lines between the manifold and the cold plate vertical portion within the valve support means, the jacket having bottom ends in heat exchange contact with the cold plate vertical portion for providing further heat exchange cooling of the beverage lines.

7. The dispenser as defined in claim 6, and the each jacket having a layer of insulation around an exterior surface thereof.

8. The dispenser as defined in claim 3, and further including a carbonator retained generally at a junction of the bottom and vertical cold plate portions and in thermal heat exchange contact therewith, the carbonator having a water inlet for connecting to a source of potable water, a carbon dioxide gas inlet for connecting to a source of pressurized carbon dioxide gas, means for regulating the level of water therein and a carbonated water outlet for connecting to the manifold.

* * * * *